US006487980B2

(12) United States Patent
Wilhelmi et al.

(10) Patent No.: US 6,487,980 B2
(45) Date of Patent: Dec. 3, 2002

(54) REFRACTORY CERAMIC PLATE AND ACCOMPANYING WALL STRUCTURE FOR AN INCINERATOR

(75) Inventors: Bruno Wilhelmi, Spiesheim (DE); Klaus Eichler, Carlsberg (DE); Herbert Kinne, Taunusstein (DE); Markus Horn, Lich (DE); Max Köpf, Wiesbaden (DE); Alfred Frey, Wattenheim (DE)

(73) Assignee: Didier-Werke AG (DE)

( * ) Notice: Subject to any disclaimer, the term of this patent is extended or adjusted under 35 U.S.C. 154(b) by 0 days.

(21) Appl. No.: 09/777,573

(22) Filed: Feb. 6, 2001

(65) Prior Publication Data

US 2001/0015158 A1 Aug. 23, 2001

(30) Foreign Application Priority Data

Feb. 8, 2000 (DE) ..... 100 05 426

(51) Int. Cl.[7] ..... F23M 5/02
(52) U.S. Cl. ..... 110/336; 110/339
(58) Field of Search ..... 110/336, 337, 110/338, 339; 202/267.1, 267.2; 122/6 R, 6 A; 52/506.02, 385, 513; 60/752, 753

(56) References Cited

U.S. PATENT DOCUMENTS

| | | | | | |
|---|---|---|---|---|---|
| 1,109,553 | A | * | 9/1914 | Slick | |
| 2,033,175 | A | * | 3/1936 | Biery | 122/6 |
| 2,463,217 | A | * | 3/1949 | Tonneson | 72/101 |
| 2,553,393 | A | * | 5/1951 | Weber | 72/101 |
| 2,705,476 | A | * | 4/1955 | Hardgrove | 122/6 |
| 2,725,833 | A | * | 12/1955 | Reintjes | 110/99 |
| 3,204,587 | A | * | 9/1965 | Birse | 110/99 |
| 3,282,231 | A | * | 11/1966 | Walt | 110/99 |
| 3,405,668 | A | * | 10/1968 | Stein | 110/99 |
| 3,789,780 | A | * | 2/1974 | Longenecker | 110/1 A |
| 3,828,735 | A | * | 8/1974 | Graham et al. | 122/6 A |
| 3,850,146 | A | * | 11/1974 | Graham et al. | 122/6 A |
| 4,136,625 | A | * | 1/1979 | Corbert et al. | 431/336 |
| 4,246,852 | A | * | 1/1981 | Werych | 110/336 |
| 4,291,514 | A | | 9/1981 | Harvey | 52/509 |
| 4,763,584 | A | * | 8/1988 | Zieren | 110/323 |
| 4,809,645 | A | * | 3/1989 | Fournier et al. | 122/6 A |
| 5,083,424 | A | * | 1/1992 | Becker | 60/39.31 |
| 5,107,641 | A | * | 4/1992 | Davis | 52/127.7 |
| 5,673,527 | A | * | 10/1997 | Coston et al. | 52/506.02 |

FOREIGN PATENT DOCUMENTS

| | | | | |
|---|---|---|---|---|
| DE | 89 08 821.2 | | 11/1989 | |
| DE | 90 16 206.4 | | 3/1991 | |
| DE | 40 07 662 | C1 | 5/1991 | |
| DE | 44 20 294 | C2 | 4/1998 | |
| EP | 0656508 | * | 6/1995 | F23M/5/04 |
| EP | 0 856 701 | A2 | 8/1998 | |
| EP | 0 962 696 | A1 | 12/1999 | |
| FR | 0355706 | * | 2/1990 | F23M/5/08 |

* cited by examiner

*Primary Examiner*—Ira S. Lazarus
*Assistant Examiner*—K. B. Rinehart
(74) *Attorney, Agent, or Firm*—Mark Kusner; Michael A. Jaffe

(57) ABSTRACT

A refractory ceramic plate and an accompanying wall structure for an incinerator, such as a garbage incinerator. The refractory ceramic plate has at least two recesses arranged on a main surface of the plate, wherein a blind hole runs from each recess to the interior of the plate. The wall structure features a furnace wall, in which numerous pipes spaced apart from each other, through which a fluid can flow, are arranged. Anchors are secured to sections of the furnace wall with one end, and project essentially perpendicularly from the furnace wall. A hollow space is formed between the furnace wall and the refractory ceramic plates spaced parallel apart from the furnace wall. Joints are formed between boundary regions of the refractory ceramic plates on main surfaces thereof, facing the furnace wall. The anchors lie in the joints, with free ends embedded in a heat-resistant filling. A heat-resistant, deformable compensating layer is provided in the joint area between adjacent plates. A refractory compound fills the hollow space between the furnace wall and the refractory ceramic plates, and covers sections of the anchors running into the hollow space.

18 Claims, 3 Drawing Sheets

REFRACTORY CERAMIC PLATE AND ACCOMPANYING WALL STRUCTURE FOR AN INCINERATOR

DESCRIPTION

1. Field of Invention

The invention relates to a refractory ceramic plate and an accompanying wall structure for an incinerator, for example a garbage incinerator.

2. Background of the Invention and Description of Related Art

DE 44 20 294 C2 describes a basic wall structure for such a garbage incinerator.

According to this publication, the wall structure comprises a (mostly metallic) furnace wall, in which numerous pipes spaced apart from each other are arranged, through which a fluid, mostly water, flows during operation.

Anchors are secured to the furnace wall, which are essentially spaced perpendicularly apart from the furnace wall, and provide reinforcement in a ceramic compound lying adjacent to the furnace wall, downstream from which are the refractory ceramic plates toward the interior of the furnace.

Both the refractory plates and the compound located behind them must exhibit good thermal conductivity to convey heat from the interior of the furnace to the pipes carrying the fluid. The heated fluid is used to generate steam and/or current, or as a secondary power for heating purposes.

The known wall structure satisfies these requirements.

In addition to good thermal conductivity, a high corrosion resistance to the aggressive combustion gasses in the furnace space is required. This applies both to the plates and the refractory compound behind them. This is also intended to protect the furnace wall against corrosion.

The object of the invention is to find a way to adapt the wall structure of the mentioned type to various applications with respect to its thermal conduction. In addition, the goal is to have the wall structure be able to withstand length changes in the plates during exposure to changing temperatures without any problem.

BRIEF SUMMARY OF THE INVENTION

The solution according to the invention described below is based on various considerations:

In order to make the flow of heat from the interior space of the furnace to the pipes carrying the fluid adjustable, the monolithic layer between the furnace wall and plates must have a variable width (thickness). As a result, we know that the reinforcing anchors must not be allowed to end in the monolithic compound, but must be expanded in such a way as to extend through the monolithic compound, and hence simultaneously serve to hold the preceding plates.

In this case, the anchors must be joined in corresponding recesses of the plates in such a way that no cracks form in the plates, even when the plate length changes during exposure to a variable temperature. From this standpoint, the invention also provides that a deformable compensating layer be placed in the boundary region between adjacent plates. In its most general embodiment, the wall structure is characterized by the following features:

- a furnace wall, in which numerous pipes, spaced apart from each other are arranged, through which a fluid can flow,
- anchors being secured to sections of the furnace wall with one end, and which are projecting essentially perpendicularly from the furnace wall,
- refractory ceramic plates which exhibit recesses with the formation of a hollow space between the furnace wall and the plates spaced parallel apart from the furnace wall, and with the formation of joints between their boundary regions on their main surfaces facing the furnace wall, in which the anchors lie with their free ends embedded in a heat-resistant filling, as well deformable during exposure to heat,
- heat-resistant, deformable compensating layers in the joint area between adjacent plates, and
- a refractory compound filling the hollow space and covering sections of the anchors.

In this wall structure, the plates adjacent to the furnace space are "floating" mounted. They are secured and aligned relative to each other by means of the anchors. However, the anchors do not lie flush in corresponding recesses of the plates. Instead, a deformable, heat-resistant filling that compensates for length changes during exposure to temperature is provided around the corresponding sections of the anchors. The same holds true for the heat-resistant, deformable compensating layers arranged in the joint areas.

The distance between the plates and furnace wall can be set as desired over the length of the anchors. In this way, the flow of heat from the furnace space to the pipes of the furnace wall can be set. The distance between the plates and furnace wall can be alternatively or cumulatively defined via the spacers, which can be designed as an integral component of the plates.

At least two boundary regions of the plate can be coated with a deformable, heat resistant compensating layer, if necessary, except for in the area of accompanying recesses.

The plates are especially easy to secure to the anchors, which permits easy and quick assembly, along with replaceability.

Before describing the wall structure in any greater detail in various embodiments, we will first describe an accompanying refractory ceramic plate in various embodiments in greater detail.

The recesses in the plate can all be expanded to accommodate a blind hole, which is used to hold a free anchor end forming an angle, for example.

In this case, the blind hole can run essentially parallel to the main surfaces of the plate, and hence essentially parallel to the furnace wall. In this way, the plates can be mounted slightly parallel to the furnace wall.

The recesses can lie completely in the area of a main surface of the plate. However, it is also possible to design the recesses in such a way that they continue in the boundary region of the plate. This embodiment will be described in greater detail in the figure description below.

During assembly, the plates can then be placed laterally on the anchor ends forming an angle and, depending on the geometric configuration of the anchors, vertically inserted into the finally position.

As already mentioned above, a deformable compensating layer is to be situated between the corresponding boundary regions of adjacent plates. In one embodiment of the plate, this compensating layer is already permanently affixed to the plate. In a square plate with rectangular main surfaces, two adjacent boundary regions of the plate can be prefabricated in this way, for example.

In this case, the compensating layer can be made out of a fiber material, e.g., an insulating strip, which is affixed to the corresponding boundary region(s) of the plate.

As an alternative, the joint area between adjacent plates can be filled with a compressed fiber layer after the plates have been installed. To this end, a fiber mat or fiber strip, whose thickness exceeds the joint width, can initially be moistened and then (more slightly) compressed, so that it can be placed into the joint (the gap). After or while drying, the fiber layer is pressed into the joint insitu through expansion (due to the restoring forces of the fibers), and seals it off. The apparent density of the fiber layer can be increased to 2 to 3 times the original apparent density during compression (e.g., 35–70 kg/m$^3$). Crystalline fibers are particularly suited, for example those based on aluminum oxide (e.g., 95% w/w $Al_2O_3$, 5% w/w $SiO_2$). In like manner, the recesses in the plates can be filled with fiber material. This joint configuration can be converted independently of the above applications.

The fact that the anchors can be secured to defined points on the furnace wall, and the plates have a defined size, the plates can be precisely allocated by simply pinning or sliding the plates on the anchors, so that the plates are enhanced to form a continuous surface to the interior of the furnace.

Assembly can be further simplified and the assembly time shortened by using anchors having two arms that extend into recesses of adjacent plates. In this way, two anchoring points, one each on adjacent plates, can be provided with a single anchor. This is also explained in greater detail in the following description to the figures.

The plates can be made out of a material based on silicon carbide and/or aluminum oxide, e.g., with the addition of $Cr_2O_3$. Both exhibit good thermal conductivity, corrosion resistance and slagging resistance. The heat flow from the furnace to the pipes of the furnace wall can be set via the plate material and its thermal conduction.

A casting compound, in particular a so-called free-flowing casting compound, that can be filled into the hollow space without vibration aids is suitable as a refractory compound for filling the hollow space between the plates and furnace wall. In this case, cement-free compounds along with low-cement compounds can be used.

As do other refractory ceramic compounds, these casting compounds exhibit good thermal conductivity levels, and are highly corrosion resistant, so that they can protect the accompanying furnace wall with integrated pipes.

The heat-resistant filling in the area of the recesses (around the corresponding anchor ends) can also be made out of a ceramic compound or fiber materials. Ceramic materials for this purpose can be those based on silicon carbide, vermiculite, corundum and/or bauxite, and are known as such (e.g., CARSITECT 170V from DIDIER-WERKE AG, Wiesbaden).

Other features of the invention are specified in the features of the subclaims, and in the other application documents.

BRIEF DESCRIPTION OF THE DRAWING

In the following, the invention will be described in greater detail based on an embodiment, wherein the figures show as follows in diagrammatic form.

DETAILED DESCRIPTION OF THE INVENTION

In this case, identical or equally acting means are denoted with the same reference numbers in the figures.

Figure 2:
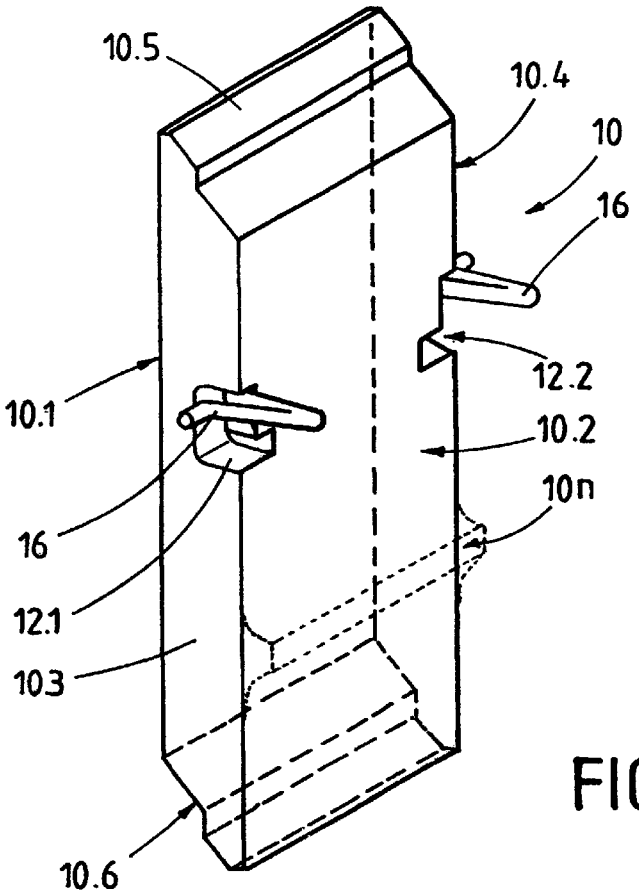
FIG. 2: A perspective view of a refractory ceramic plate.

FIG. 2 shows a plate 10 with two rectangular main surfaces 10.1, 10.2, two lateral, flat boundary regions 10.3, 10.4 and two graded upper and lower boundary regions 10.5, 10.6.

Figure 3:
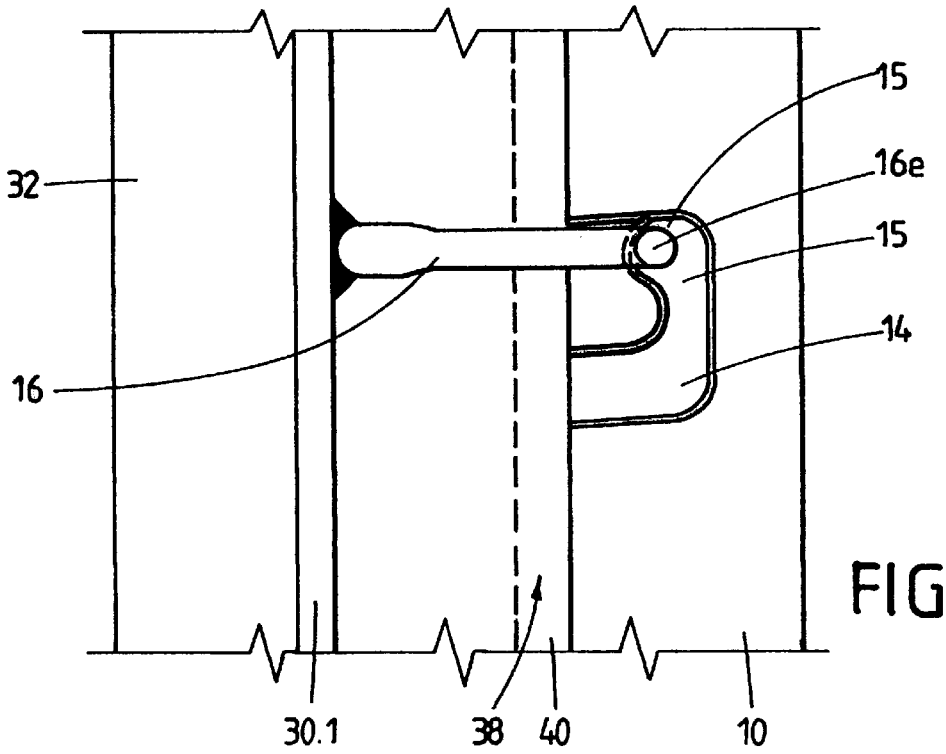
FIG. 3: A vertical section through a wall structure in the anchoring area of a plate.

In the area of the main surface 10.2 to the front in the figure, two recesses 12.1, 12.2 are provided on the outside, which continue in the respectively adjacent boundary region 10.3 or 10.4. In the area of the interior surfaces of the recesses 12.1, 12.2 running parallel to the boundary regions 10.3, 10.4, the recesses 12.1, 12.2 are lengthened via blind holes 14 to extend inside the interior of the plate, as depicted on FIG. 3.

Figure 1:
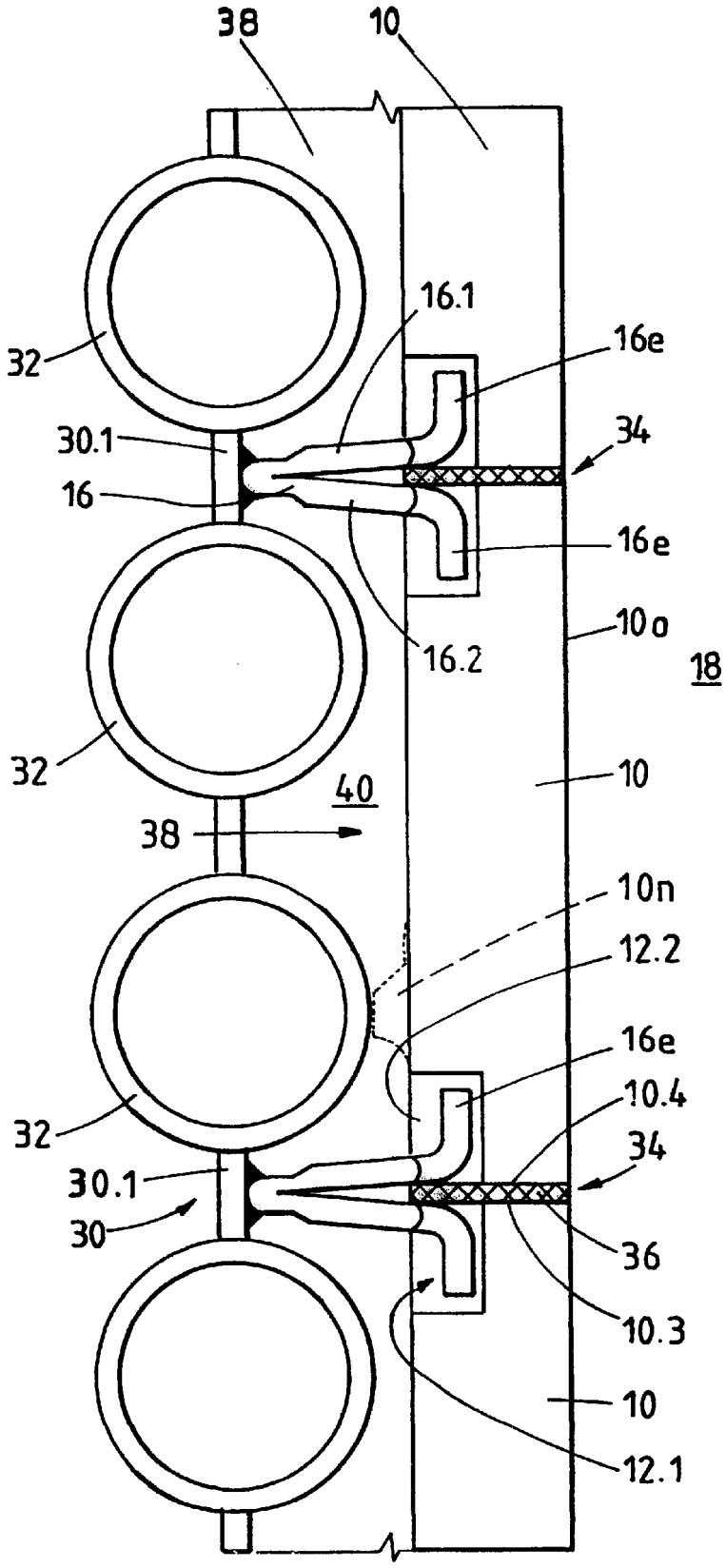
FIG. 1: A horizontal section through a wall structure.

Recesses 12.1, 12.2 and accompanying blind holes 14 are used to hold anchors, which are described in greater detail in conjunction with the following description to FIG. 1.

FIG. 1 shows a wall structure, in this case for a garbage incinerator. The wall structure encompasses a furnace wall 30 with numerous pipes 32 that are arranged parallel and spaced apart from each other, and can carry water, which project on both sides over the furnace wall sections 30.1 running between the adjacent pipes 32.

Welded to the furnace wall sections 30.1 are V-shaped metal anchors 16, which each have two arms 16.1, 16.2 and essentially run perpendicular to the furnace wall 30. The free ends **16*e* of the anchor arms 16.1, 16.2 are oppositely forming an angle, and engage the recesses 12.1, 12.2 described based on FIG. 2, or with their free ends 16e into the accompanying blind holes 14 of the plate 10**.

The remaining area of the recesses 12.1, 12.2 is filled with a heat-resistant filling 15 deformable during exposure to heat, in this case a ceramic compound based on silicon carbide, in which the anchors 16 are inserted with their ends **16*e***.

As evident from FIG. 1, a plate 10 is held and aligned on the corresponding anchor arms 16.1, 16.2. Several plates 10 are fabricated next to and over each other, thereby creating a self-contained wall surface with flat, parallel surface 10 toward the interior of the furnace 18. In this case, adjacent plates 10 are spaced narrowly apart with the formation of corresponding joints 34, which are filled by a deformable, compressed insulating strip 36 made out of ceramic fiber material.

The arrangement of plates 10 establishes a hollow space 38 between the plate wall and furnace wall 30, which is filled with a refractory casting compound based on aluminum oxide, and covers the anchor arms 16.1, 16.2 at the same time.

The plates 10 and compound 40 located in the hollow space 38 have a good thermal conductivity and corrosion resistance to aggressive gasses.

The distance between the back sides 10.1 of the plates 10 and the furnace wall 30 can be adjusted via the length of the anchors 16. Alternatively or cumulatively, the distance can also be set using spacers, which are indicated on FIGS. 1 and 2 dotted, and marked **10*n*. The spacers 10*n* are here molded by material-fit from the surface of the plates 10 facing the furnace wall 30, and lie adjacent to corresponding pipes 32**.

During operation, there are length changes in the area of the plates 10. If these take place perpendicular to the furnace wall 30, the plates 10 can "grow" in the direction of the interior of the furnace. In the area of recesses 12.1, 12.2, the resilient, deformable filling compound 15 ensures that corresponding length changes are compensated.

This applies similarly to length changes parallel to the furnace wall 30, wherein the insulating strips 36 in the joints 34 also follow expansions and contractions of the plates 10, in this way reliably keeping the joints 34 sealed.

As opposed to FIG. 2, the boundary regions 10.5, 10.6 of the plates can also be planar (flat). Any other geometry is also possible for the plates 10.

Figure 4:
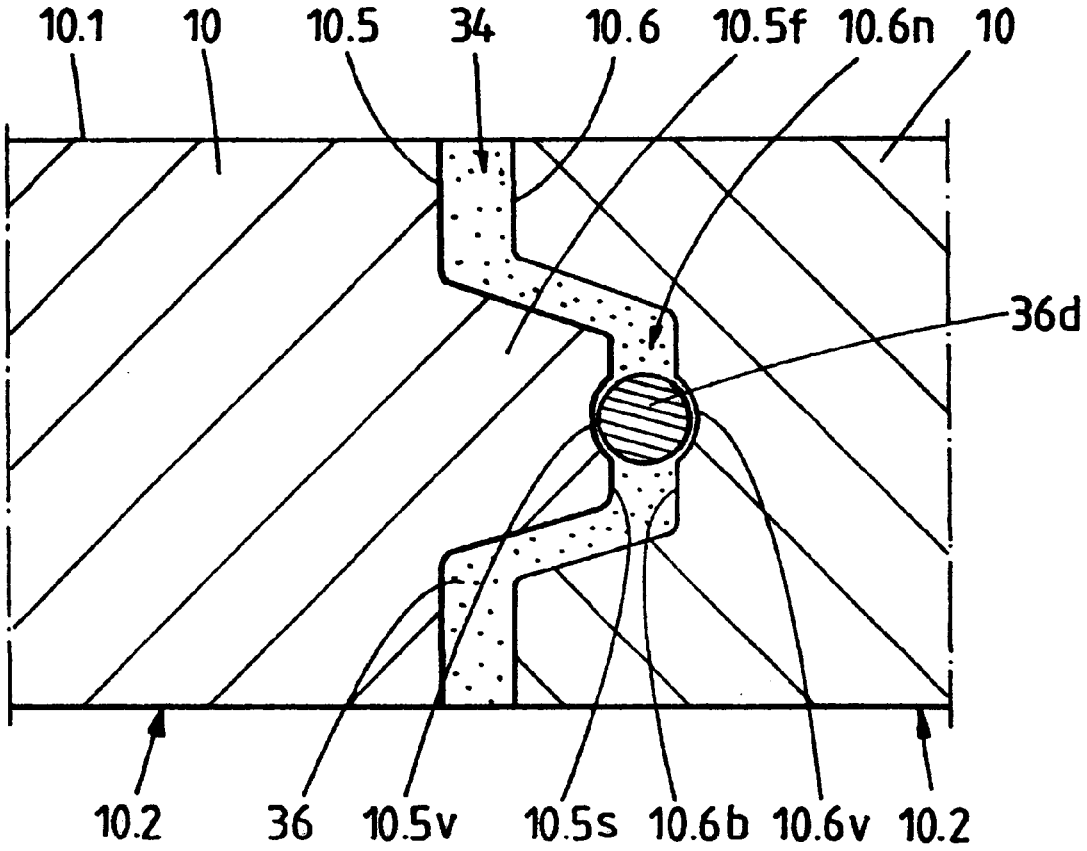
FIG. 4: A section perpendicular to the joint area between adjacent plates.

FIG. 4 shows another configuration of plates 10 and joints 34 between the plates 10. Corresponding surface sections 10.5, 10.6 of plates 10 are here designed as a kind of groove/spring connection, namely with spring 10.5*f* or groove 10.6*n* in the area between corresponding main surfaces 10.1, 10.2. The face 10.5*s* of the spring 10.5*f* and the base 10.6*b* of the groove 10.6*n* are here provided with channel-type depressions 10.5*v*, 10.6*v*, which hold a ceramic sealing cord 36*d*, while the remaining joint area 34 is filled with a ceramic fiber material or resilient ceramic filler 36, as described above. This joint formation is possible independently of the area of application described above.

What is claimed is:

1. Refractory ceramic plate (10) for a wall structure of an incinerator, with at least two recesses (12.1, 12.2) arranged on a main surface (10.2) of the plate (10), wherein a blind hole (14) runs from each recess (12.1, 12.2) into the interior of the plate and in which the blind hole runs essentially parallel to the main surfaces (10.1, 10.2) of the plate (10).

2. Plate according to claim 1, in which the recesses (12.1, 12.2) continue in a corresponding boundary region (10.3, 10.4) of the plate (10).

3. Plate according to claim 1, in which at least two boundary regions (10.4, 10.5) of the plate (10) are coated with a deformable, heat-resistant compensating layer (36).

4. Plate according to claim 1, square-shaped.

5. Plate according to claim 3, in which the compensating layer (36) consists of a fiber material.

6. Plate according to claim 5, in which the fiber material is affixed to the boundary region(s) (10.4, 10.5) of the plate (10) as a strip.

7. Wall structure for an incinerator, comprising:

a furnace wall (30), in which numerous pipes (32) spaced apart from each other, through which a fluid can flow, are arranged, anchors (16) being secured to sections (30.1) of the furnace wall (30) with one end, and which are projecting essentially perpendicularly from the furnace wall, refractory ceramic plates (10) which exhibit recesses (12.1, 12.2) with the formation of a hollow space (38) between the furnace wall (30) and the plates (10) spaced parallel apart from the furnace wall (30), and with the formation of joints (34) between boundary regions (10.3, 10.4, 10.5, 10.6) of said plates (10) on main surfaces (10.1, 10.2) of said plates (10) facing the furnace wall (30), in which the anchors (16) lie with free ends (16*e*) embedded in a heat-resistant filling (15) deformable during exposure to heat, wherein said anchors (16) are forming an angle at the free ends (16*e*) of said anchor (16) lying in the recesses (12.1, 12.2) of the plates (10), and the free ends (16*e*) essentially run parallel to the furnace wall (30) and wherein the free ends (16*e*) of the anchors (16) forming an angle lie in blind holes (14), which are adjacent to the recesses (12.1, 12.2), heat-resistant, deformable compensating layers (36) in the joint area (34) between adjacent plates (10), and a refractory compound (40) filling the hollow space (38) and covering sections (16.1, 16.2) of the anchors (16) running into the hollow space (38).

8. Wall structure according to claim 7, in which each anchor (16) has two arms (16.1, 16.2) that lie in recesses (12.1, 12.2) of adjacent plates (10).

9. Wall structure according to claim 7, in which the plates (10) are made out of a material based on silicon carbide.

10. Wall structure according to claim 7, in which the plates (10) are made out of a material based on aluminum oxide.

11. Wall structure according to claim 7, in which the refractory compound (38) is a casting compound.

12. Wall structure according to claim 7, in which the refractory compound (38) is a cement-free compound.

13. Wall structure according to claim 7, in which the heat-resistant filling (15) is made out of a ceramic compound.

14. Wall structure according to claim 7, in which the heat-resistant filling (15) is made out of a material based on vermiculite, silicon carbide, corundum or bauxite.

15. Wall structure according to claim 7, in which the heat-resistant, deformable compensating layer (36) is made out of a fiber material.

16. Wall structure according to claim 7, in which the plates (10) are designed according to one of claims 1 to 7.

17. Wall structure according to claim 7, in which spacers (10*n*) are arranged between the pipes (32) and the surfaces of the plates (10) facing the furnace wall (30).

18. Wall structure according to claim 17, in which the spacers (10*n*) are molded from the plates (10).

* * * * *